US005513454A

United States Patent [19]

Kao et al.

[11] Patent Number: 5,513,454

[45] Date of Patent: May 7, 1996

[54] SOUND PRODUCING CONTROL CIRCUIT ASSEMBLY FOR PICTURE FRAMES

[76] Inventors: Chao-Hsiang Kao, 2F, No. 7, Alley 3, Lane 27, Sec. 4, Chung Cheng Rd., Tu-Cheng,, Taipei Hsien; Tung-Ying Lee, No. 33, Kuang Ming 3 Rd., Nan Tou City, Nan Tou Hsien, both of Taiwan

[21] Appl. No.: 248,212

[22] Filed: May 24, 1994

[51] Int. Cl.[6] ..... A62H 33/38

[52] U.S. Cl. ..... 40/714; 40/455; 40/457

[58] Field of Search ..... 40/152, 152.1, 40/455, 457

[56] References Cited

U.S. PATENT DOCUMENTS 4,531,310 7/1985 Acson et al. ..... 40/455 X 5,182,872 2/1993 Lee et al. ..... 40/455 X

*Primary Examiner*—Kenneth J. Dorner

*Assistant Examiner*—Cassandra Davis

*Attorney, Agent, or Firm*—Birch, Stewart, Kolasch & Birch

[57] ABSTRACT

A sound producing control circuit assembly includes a box covered with a fixed supporting board and fastened to a picture frame at the back to hold a sound producing circuit. A movable conductive board is supported on springs above the fixed supporting board and is urged against the glass of the picture frame to hold down a picture. The fixed supporting board has a first contact metal plate and a second contact metal plate with contact legs spaced above the first contact metal plate for controlling the operation of the sound producing circuit. When the glass is pressed against the movable conductive plate, at least one contact leg of the second contact metal plate is forced to contact the first contact metal plate causing the sound producing circuit to be electrically connected to thereby produce sound.

2 Claims, 4 Drawing Sheets

SOUND PRODUCING CONTROL CIRCUIT ASSEMBLY FOR PICTURE FRAMES

BACKGROUND OF THE INVENTION

The present invention relates to a sound producing control circuit assembly for a picture frame which produces sound when the glass of the picture frame is depressed.

A variety of picture frames are known for holding pictures or photographs. These picture frames may be various shaped and decorated with different decorations, they cause only a static sense of beauty and are less attractive to consumers. In order to attract consumers to purchase the frame, it is good to provide a standing picture frame with a miniature sound producing electronic device. When a miniature sound producing electronic device is installed in a picture frame, a control switch is needed.

SUMMARY OF THE INVENTION

The present invention has been accomplished to accomplish this goal. According to the present invention, the sound producing control circuit assembly comprises a box covered with a fixed supporting board and fastened to a picture frame at the back to hold a sound producing circuit, and a movable conductive board supported on springs above the fixed supporting board and urged against the glass of the picture frame to hold down a picture. The fixed supporting board has a first contact metal plate and a second contact metal plate with contact legs spaced above the first contact metal plate for controlling the operation of the sound producing circuit. When the glass is pressed against the movable conductive plate, at least one contact leg of the second contact metal plate is forced to contact the first contact metal plate causing the sound producing circuit electrically connected to produce sound or to give the correct time. The sound producing circuit may comprise a miniature recorder for recording a short speech such as "How are young?" "I miss you so much", etc., so that it speaks out when the glass is depressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
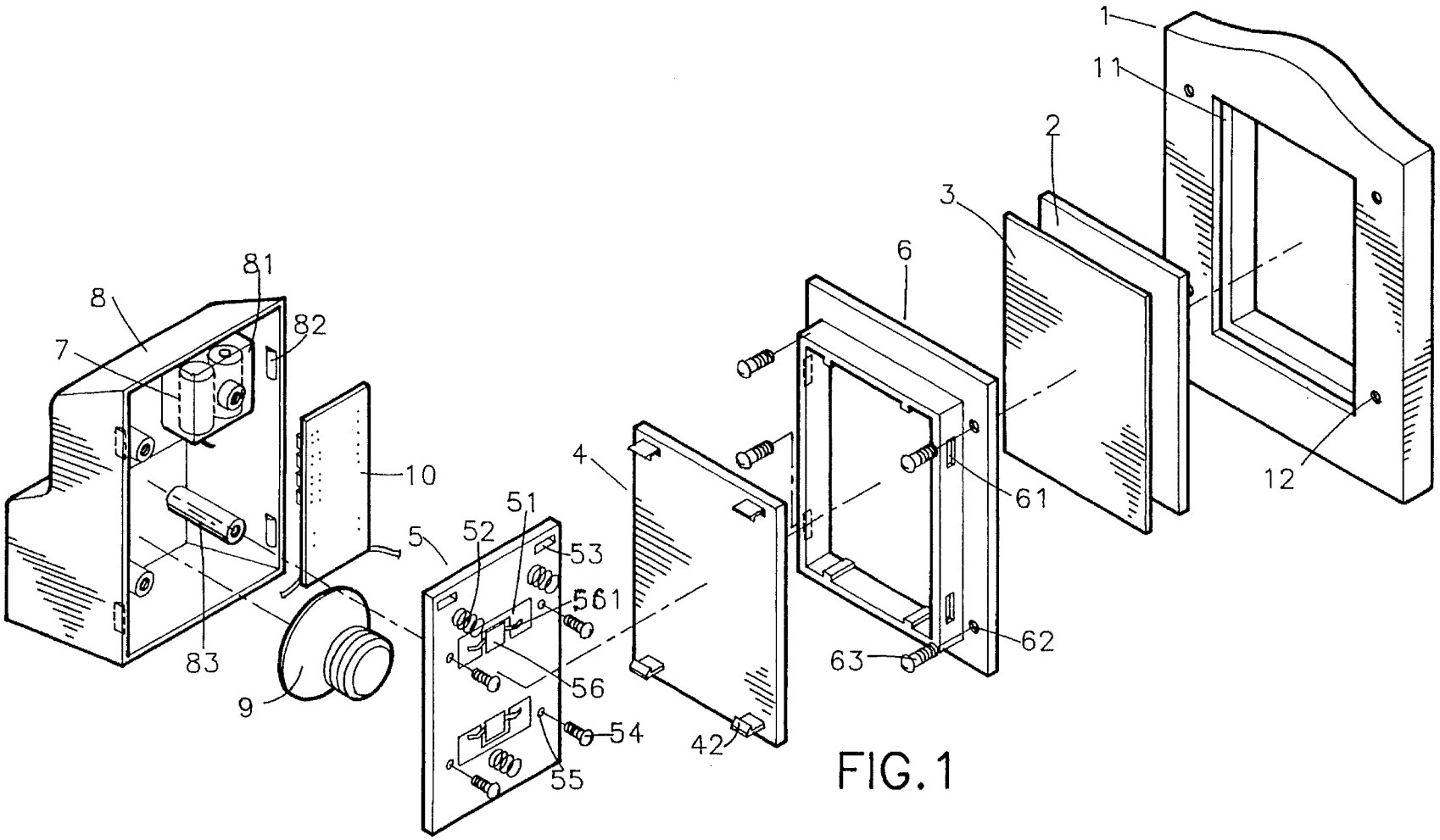
FIG. 1 is an exploded view of the present invention.
Figure 2:
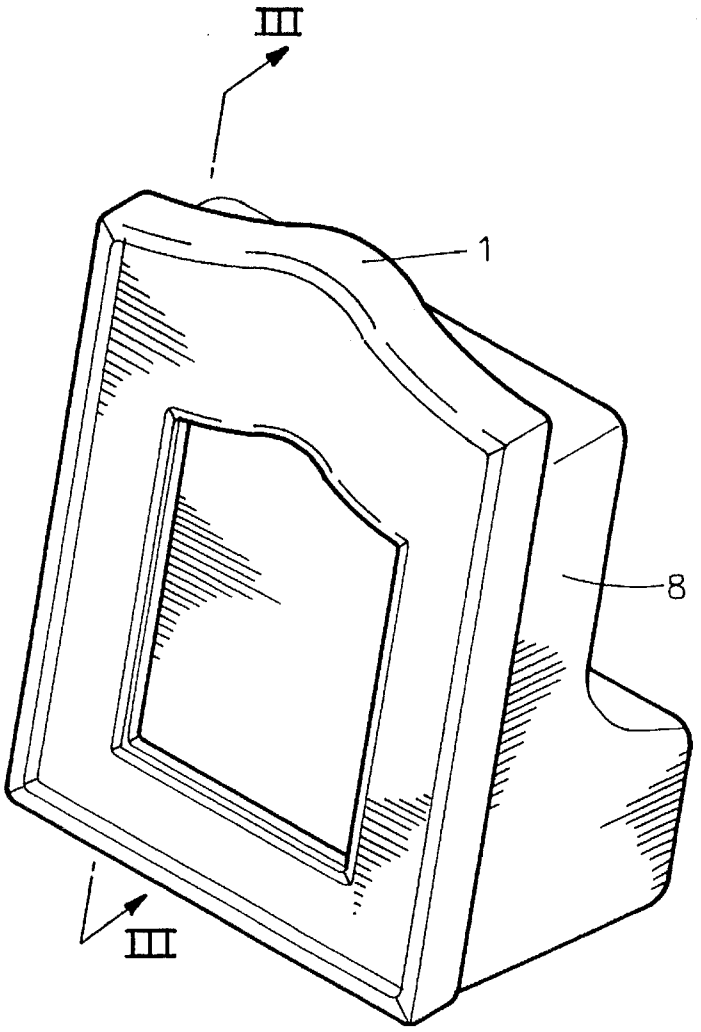
FIG. 2 is an elevational view thereof.

Referring to FIGS. 1 and 2, the present invention comprises mainly a front open frame 1, a glass 2, a picture 3, a movable conductive board 4, a fixed supporting board 5, a mount 6, a battery set 7, a cover box 8, a speaker 9, and a circuit board 10.

Figure 4:
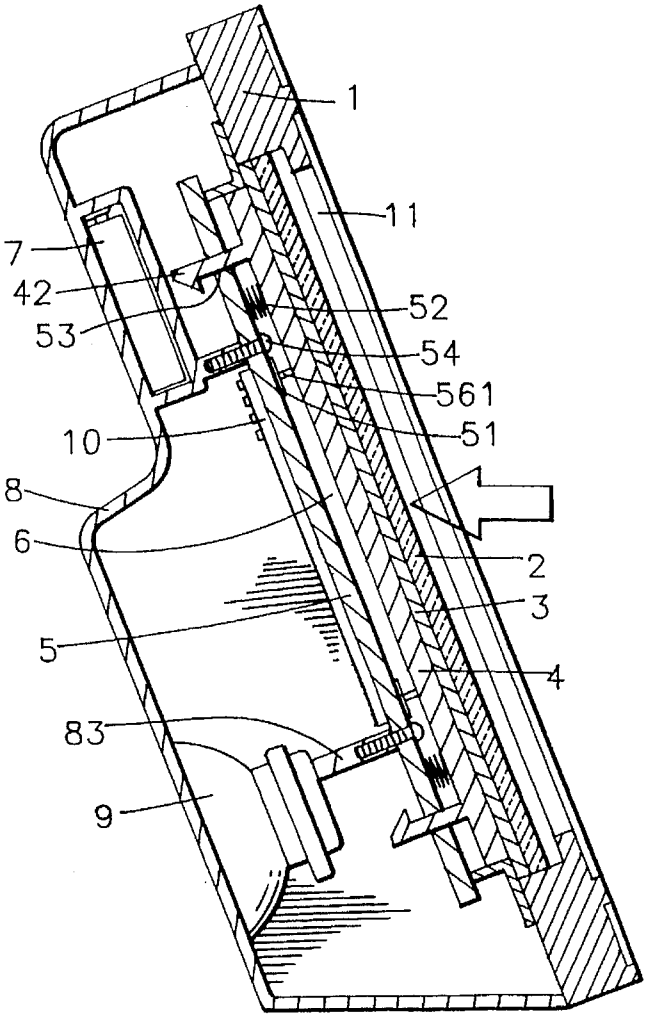
FIG. 4 is similar to FIG. 3 but showing the switch depressed.
Figure 3:
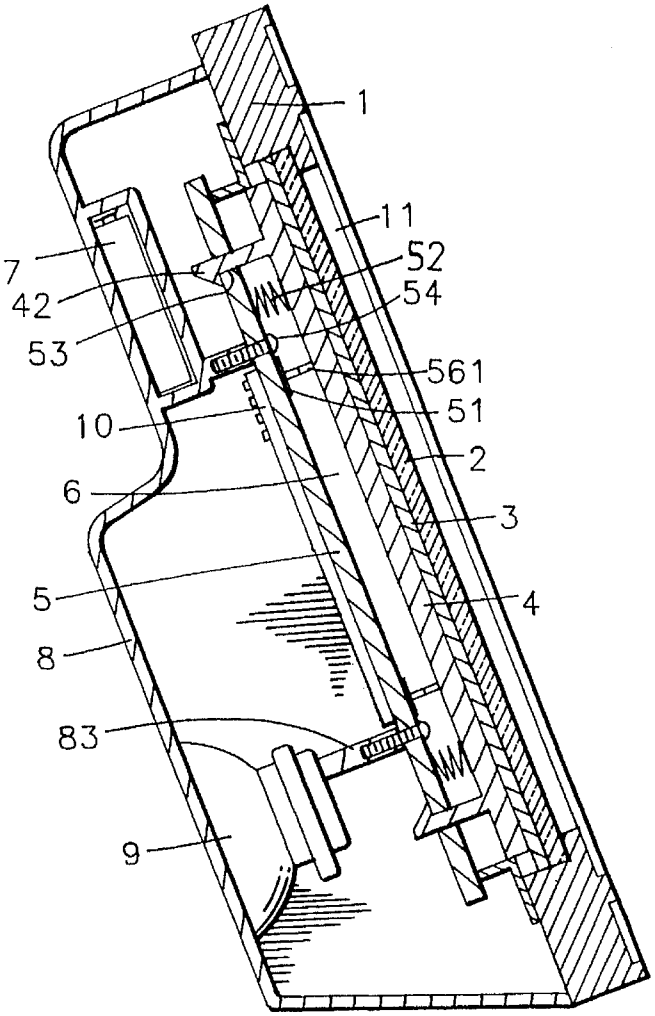
FIG. 3 is a sectional view thereof taken along line III—III in FIG. 2.
Figure 5:
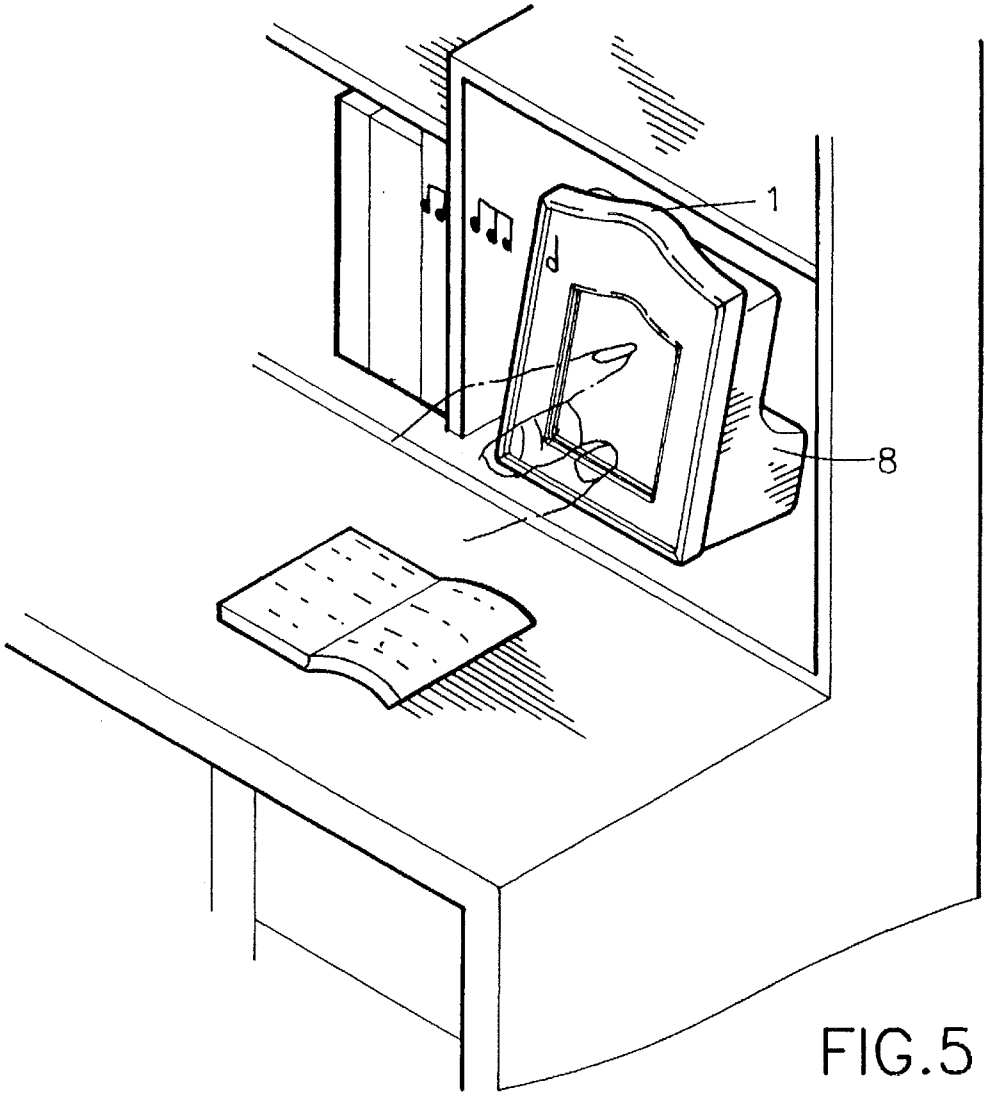
FIG. 5 is an applied view of the present invention.

Referring to FIGS. 3 and 4 and FIGS. 1 and 2 again, the front open frame 1 comprises an inside flange 11 around the opening thereof for mounting the glass 2 and the picture 3, and a plurality of screw holes 12 at the back around the border thereof. The back open frame 6 has a plurality of screw holes 62 around the border thereof respectively connected to the screw holes 12 on the front open frame 1 by screws 63 to hold down the glass 2 and the picture 3 on the inside flange 11 within the central opening of the front open frame 1 permitting the picture 3 to be retained between the glass 2 and the back open frame 6. The back cover box 8 comprises a battery chamber 81, which holds the battery set 7. The speaker 9 and the circuit board 10 are received inside the back cover box 8 and then covered by the fixed supporting board 5. By threading screws 54 into screw holes 55 on the fixed supporting board 5 and respective female screws 83 on the back cover box 8, the fixed supporting board 5 is fastened to the back cover box 8 on the inside and covered over the speaker the battery chamber 81, the speaker 9 and the circuit board 10. The fixed supporting board 5 is made of non-conductive material, comprising at least one set of contact metal plates each of which is comprised of a first contact metal plate 51 and a second contact metal plate 56, a plurality of springs 52, and a plurality of hook holes 53. The first and second contact metal plates 51 and 56 are respectively connected to the two opposite terminals of the battery set 7 through the circuit board 10. The second contact metal plate 56 has two legs 561 spaced above the first contact metal plate 52. The movable conductive board 4 is supported on the springs 52 and disposed in parallel with the fixed supporting board 5, having a plurality of hooks 42 respectively hooked in the hook holes 53 on the fixed supporting board 5. When the movable conductive board 4 is pressed against the fixed supporting board 5, the legs 561 of the second contact metal plate 56 are forced to contact the first contact metal plate 51 causing the the circuit board 10 triggered to produce sound through the speaker. Furthermore, the back cover box 8 has a plurality of raised blocks 82 spaced around the inside wall thereof. The back open frame 61 has a plurality of retaining holes 61. By fitting the raised blocks 82 of the back cover box 8 into the retaining holes 61 on the back open frame 61, the back cover box 8 is fixed to the back open frame 6 causing the movable conductive board 4 to be closely attached to the back of the picture 3.

Referring to FIG. 3 again, when assembled, the movable conductive board 4 is spaced from the fixed supporting board 5 by the springs 52, and therefore the legs 561 of the first second contact metal plate 56 are disconnected from the first contact metal plate 51, i.e., the circuit board 10 is at a broken circuit state.

Referring to FIG. 4 again, when the glass 2 is pressed down, the movable conductive board 4 is forced to press the legs 561 of the second contact metal plate 56 against the first contact metal plate 51 causing the circuit board 10 to be electrically connected to send out a speech or to give the correct time through the speaker 9. The circuit board 10 may comprise a miniature recorder for recording a short speech such as "How are you? ", "I miss you so much?", etc. When the glass 2 is pressed, the circuit board 10 is immediately triggered to send out the recorded speech. When the hand is released from the glass 2, the movable conductive board 4 is immediately pushed away from the fixed supporting board 5 by the springs 52, causing the circuit board 10 to be returned to the broken circuit state again.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sound producing control circuit assembly comprising a front open frame, a glass mounted within said front open frame, a back open frame fastened to a back of said front open frame to hold down a picture on said glass, a back cover box fastened to a back of said back open frame, a battery power supply mounted within said back cover box, a sound producing circuit board mounted within said back cover box, a speaker connected to output end of said sound producing circuit board, and a control switch connected between said battery power supply and said sound producing circuit board, wherein said control switch comprises a fixed supporting board made of non-conductive material fixed to said back cover box and having at least one pair of contact metal plates and a plurality of spring raised from one side thereof, each pair of contact metal plates having a first contact metal plate and a second contact metal plate with two contact legs spaced from said first contact metal plate, and a movable conductive board supported on the springs of said fixed supporting board and closely attached to said picture against said glass, said sound producing circuit board being electrically connected to produce sound through said speaker when either contact leg of said second contact metal plate contacts said first contact metal plate, at least one of said contact legs of said second contact metal plate being forced to contact said first contact metal plate when said glass is urged toward said movable conductive board.

2. The sound producing control circuit assembly of claim 1, wherein said second contact metal plate is spaced above said first contact metal plate.

* * * * *